US008265331B2

(12) United States Patent
Zhou et al.

(10) Patent No.: US 8,265,331 B2
(45) Date of Patent: Sep. 11, 2012

(54) EARPIECE FOR COMMUNICATIONS

(75) Inventors: Jundong Zhou, Shenzhen (CN); Jinjun Wang, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 586 days.

(21) Appl. No.: 12/503,002

(22) Filed: Jul. 14, 2009

(65) Prior Publication Data

US 2010/0014700 A1 Jan. 21, 2010

(30) Foreign Application Priority Data

Jul. 18, 2008 (CN) ..... 2008 2 0095582

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 25/00* | (2006.01) |

(52) U.S. Cl. ..... 381/418; 381/380; 381/398

(58) Field of Classification Search ..... 381/380, 381/398, 418

See application file for complete search history.

(56) References Cited

U.S. PATENT DOCUMENTS

| | | | | |
|---|---|---|---|---|
| 1,784,517 A | | 12/1930 | Farrand | |
| 4,000,381 A | * | 12/1976 | Plice et al. | 381/418 |
| 4,272,654 A | * | 6/1981 | Carlson | 310/20 |
| 2002/0018574 A1 | | 2/2002 | Okuno et al. | |

FOREIGN PATENT DOCUMENTS

| | | | |
|---|---|---|---|
| DE | 19840211 | C1 | 12/1999 |
| DE | 19954880 | C1 | 1/2001 |
| EP | 1353531 | A2 | 10/2003 |
| GB | 1376414 | A | 12/1974 |
| GB | 1385161 | A | 2/1975 |
| SU | 1172087 | A1 | 8/1985 |

OTHER PUBLICATIONS

*European Search Report* of corresponding European Application No. EP 09165746 issued by the European Patent Office on Sep. 7, 2009.

* cited by examiner

*Primary Examiner* — Yuwen Pan
*Assistant Examiner* — Matthew Eason
(74) *Attorney, Agent, or Firm* — Alston & Bird LLP

(57) ABSTRACT

An earpiece for communications comprises a frame, a vibration system disposed in the frame and a magnetic field system disposed in the frame. The vibration system includes a vibrating armature, a diaphragm and a connecting rod. The magnetic field system includes a magnet to generate a first magnetic field on a first axis and a coil to generate a second magnetic field on a second axis. One of the magnet and the coil is connected to the frame. The first and the second magnetic fields produce a net magnetic force to cause the vibration system to move. The first axis is parallel to the second axis.

17 Claims, 4 Drawing Sheets

EARPIECE FOR COMMUNICATIONS

CROSS-REFERENCE TO RELATED APPLICATION

This application claims foreign priority benefits under 35 U.S.C. §119 of Chinese Patent Application Serial No. 200820095582.6, filed on Jul. 18, 2008, the disclosure of which is incorporated herein by reference.

TECHNICAL FIELD

The present invention relates to an earphone, and more particular to an earpiece for communications and hearing aids.

BACKGROUND

An earphone, or earpiece, is often used with portable digital products such as MP3 players, mobile phones, personal digital assistants (PDA) and laptop computers. An earpiece generates sound through magnetic fields generated around the earpiece. A schematic of magnetic fields generated by a conventional earpiece is illustrated by FIG. 1.

Referring to FIG. 1, the earpiece (not numbered) includes a magnet 110, which is comprised of two parallel magnets 102 and 104. The north and south poles of the magnets 102 and 104 set up a first magnetic field on an axis A. Since the magnets 102 and 104 are permanent magnets, the first magnetic field is constant and uniform. A magnetic force associated with the first magnetic field is perpendicular to the axis A. The earpiece also includes a balanced armature 130, which comprises a stationary portion 130*a*, an extending portion 130*b* and an arc portion 130*c*. The stationary portion 130*a* is connected to the frame (not shown) of the earpiece. The extending portion 130*b* is capable of moving about the arc portion 130*c*. When the extending portion 130*b* is centered in the first magnetic field, no net force is exerted on it.

The earpiece further comprises a coil 120. When a current passes through the coil 120, a second magnetic field is created on an axis B. The direction of the second magnetic field is perpendicular to that of the first magnetic field, i.e., axis B is perpendicular axis A. A magnetic force associated with the second magnetic field is perpendicular to the axis B. Accordingly, a net magnetic force may be generated to cause the extending portion 130*b* to rotate about the arc portion 130*c*. The extending portion 130*b* then transmits movement to a diaphragm 140 via a connecting rod 150. Vibration of the diaphragm 140 generates sound in the earpiece. Because the net magnetic force is in a different direction than the moving direction of the extending portion 130*b*, the efficiency of the magnetic energy is reduced.

BRIEF SUMMARY

According to one exemplary embodiment of the invention, an earpiece for communications comprises a frame, a vibration system disposed in the frame and a magnetic field system disposed in the frame. The vibration system includes a vibrating armature, a diaphragm and a connecting rod. The magnetic field system includes a magnet to generate a first magnetic field on a first axis and a coil to generate a second magnetic field on a second axis. One of the magnet and the coil is connected to the frame. The first and the second magnetic fields produce a net magnetic force to cause the vibration system to move. The first axis is parallel to the second axis.

According to another exemplary embodiment of the invention, an earpiece for communications comprises a frame, a vibration system and a magnetic field system. The vibration system includes a vibrating armature, a diaphragm and a connecting rod. The vibrating armature has a stationary portion and an extending portion. The stationary portion is connected to the frame. One end of the extending portion is connected to the stationary portion to form an arc portion and the other end of the extending portion is capable of movement. The magnetic field system includes a magnet to generate a first magnetic field on a first axis and a coil to generate a second magnetic field on a second axis. One of the magnet and the coil is connected to the frame through the stationary portion. The first and the second magnetic fields produce a net magnetic force to cause the extending portion to vibrate. The extending portion transmits vibration to the diaphragm through the connecting rod. The first axis is parallel to the second axis.

According to another exemplary embodiment of the invention, an earpiece for communications comprises a frame, a vibration system and a magnetic field system. The magnetic field system includes a magnet to generate a first magnetic field on a first axis and a coil to generate a second magnetic field on a second axis. The first and the second magnetic fields share a same space within the frame and cause the vibration system to move. The first axis is parallel to the second axis.

BRIEF DESCRIPTION OF THE DRAWINGS

The foregoing summary, as well as the following detailed description of the invention, will be better understood when read in conjunction with the appended drawings. The embodiments illustrated in the figures of the accompanying drawings herein are by way of example and not by way of limitation. In the drawings.

DETAILED DESCRIPTION

Figure 1:
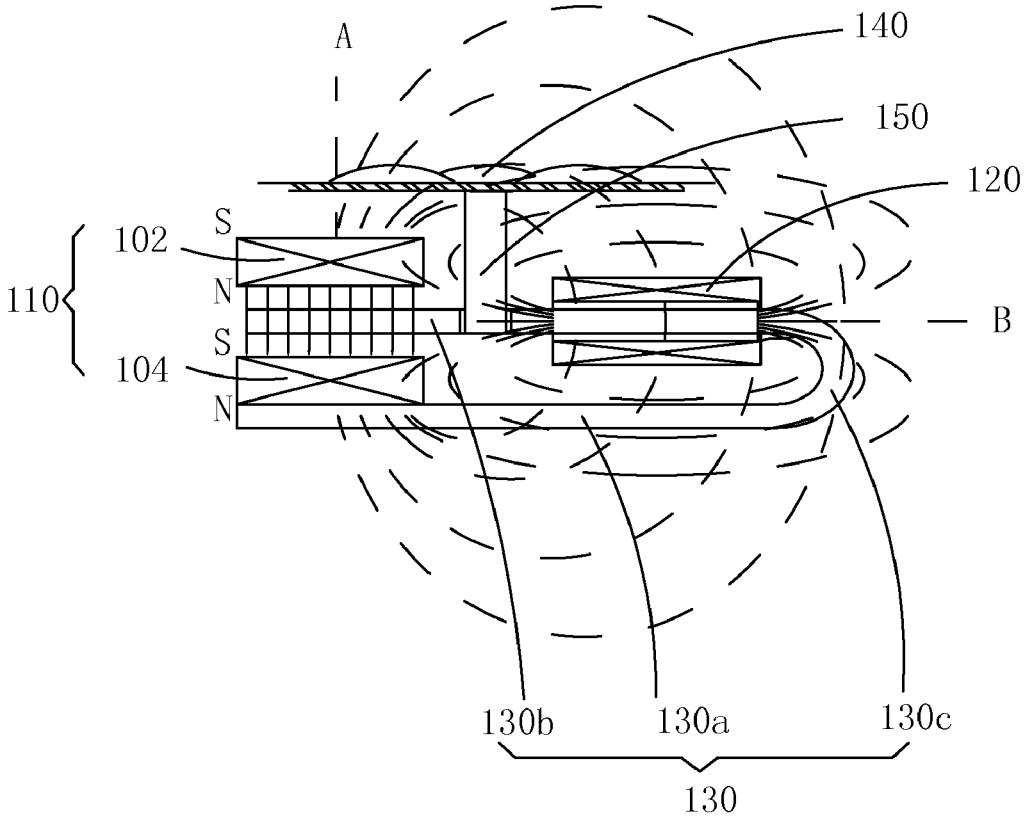
Fig. 1 Prior Art
FIG. 1 illustrates a schematic of magnetic fields generated by a conventional earpiece.
Figure 2:
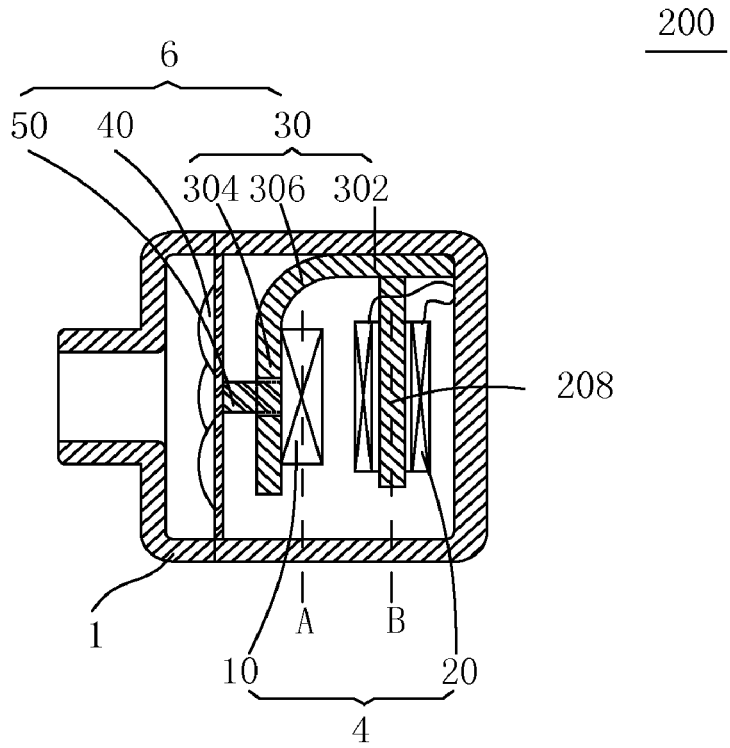
FIG. 2 illustrates a cross-section view of an earpiece according to one exemplary embodiment of the present invention.
Figure 3:
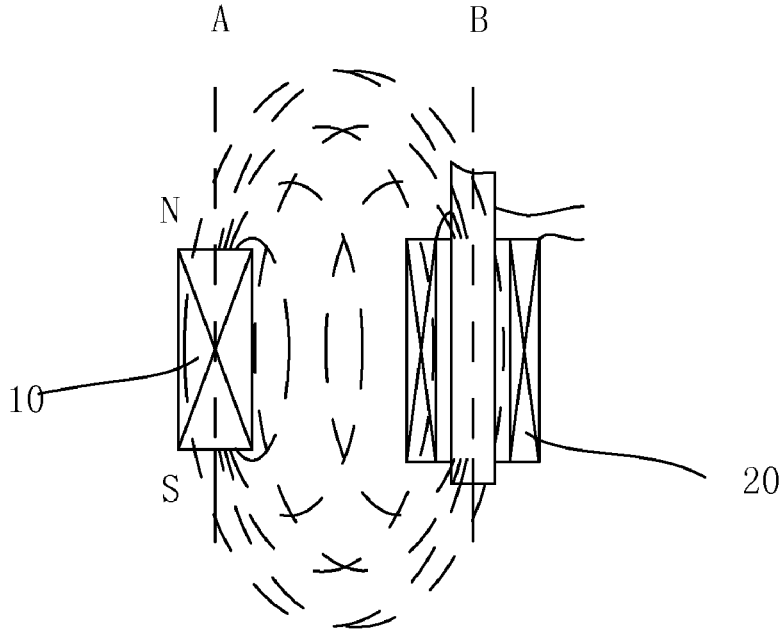
FIG. 3 illustrates a schematic of magnetic fields generated by the earpiece shown in FIG. 2.

FIG. 2 illustrates a cross-section view of an earpiece 200 according to one exemplary embodiment of the present invention. The earpiece 200 comprises a frame 1, a magnetic field generation system 4 and a vibration system 6. The magnetic field generation system 4 comprises a permanent magnet 10 to produce a first magnetic field between the two poles of the magnet. The direction of the first magnetic field is along an axis A. The magnetic field generation system 4 may further comprise a coil 20. When an electric current passes through the coil 20, a second magnetic field around the coil 20 is generated on an axis B. Both magnetic fields are generated inside the frame 1 and share the same space. A schematic of the magnetic fields generated by the magnet 10 and the coil 20 respectively on axes A and B are illustrated in FIG. 3. As shown in FIG. 3, the axis A is parallel to the axis B. The net magnetic force is in a direction perpendicular to the axes A and B. The net magnetic force moves one of the magnet 10 and the coil 20.

Referring again to FIG. 2, the vibration system 6 comprises a vibrating armature 30, a diaphragm 40 and a connecting rod 50. The vibrating armature 30 includes a stationary portion 302 and an extending portion 304. The stationary portion 302 is connected to the frame 1. One end of the extending portion 304 is connected to the stationary portion 302 to form an arc portion 306. The other end is not held in place. The diaphragm 40 is disposed in the proximity of an outlet (not numbered) of the frame 1 where sound is projected outward. The diaphragm 40 is operatively coupled to the vibrating armature 30 by the connecting rod 50. In one embodiment, the coil 20 and magnet 10 are disposed in series with the diaphragm 40.

In various embodiments, one of the magnet 10 and the coil 20 is connected to the frame 1 by the stationary portion 302. For convenience and brevity, the one which is connected to the frame 1 is called a "fixed element." The other one of the magnet 10 and the coil 20 is connected to the extending portion 304 and may move under the net magnetic force. This element is termed "moving element."

As illustrated in FIG. 2, a coil pole 208 is at least partially surrounded by the coil 20. The coil pole 208 is connected to the frame 1 through the stationary portion 302. Thus, in this embodiment, the coil 20 is the fixed element. The magnet 10 is connected to the extending portion 304 which is not held in place by the frame. Accordingly, in this embodiment, the magnet 10 is the moving element.

Referring to FIG. 3, the axis B is parallel to the axis A, so the net magnetic force may be in the same direction as the movement of the moving element which is perpendicular to the axes A and B. Since the second magnetic field is constantly changing along with the current, a two-way magnetic force perpendicular to the axes A and B may be achieved that causes the magnet 10 and the extending portion 304 to vibrate about the arc portion 306. As a result, the connecting rod 50 may carry the vibration from the extending portion 304 to the diaphragm 40. In one embodiment, the coil 20 and magnet 10 are disposed in series with the diaphragm 40 relative to the movement of the vibrating system.

Figure 4:
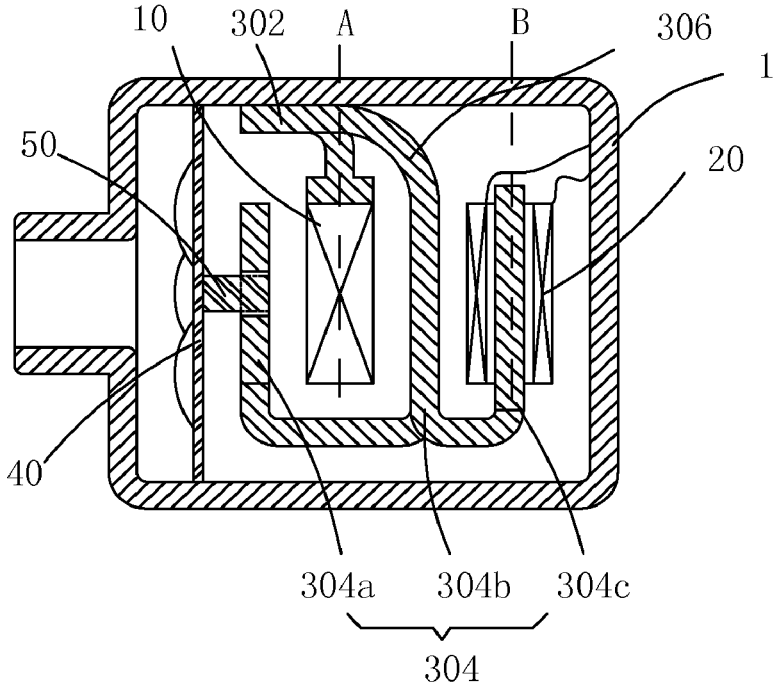
FIG. 4 illustrates a cross-section view of an earpiece according to another exemplary embodiment of the present invention.

FIGS. 4-7 illustrate various exemplary embodiments of the present invention. In these embodiments, the extending portion 304 has different shapes. As shown in FIG. 4, the extending portion 304 is formed in two approximately "U" shapes having arms 304*a*, 304*b* and 304*c*. The arm 304*a* is connected to the connecting rod 50. The arm 304*c* serves as the coil pole which is at least partially surrounded by the coil 20. The arm 304*b* is connected to the stationary portion 302 to form the arc portion 306. Since the magnet 10 is connected to the frame 1 through the stationary portion 302, the magnet 10 is the fixed element in this embodiment. The coil 20 is the moving element. The movement of the coil 20 may cause the arm 304*a* to vibrate in a direction perpendicular to the axes A and B when electric current passes through the coil 20. As a result, the arm 304*a* transmits vibration to the diaphragm 40 through the connecting rod 50 to generate sound.

Figure 5:
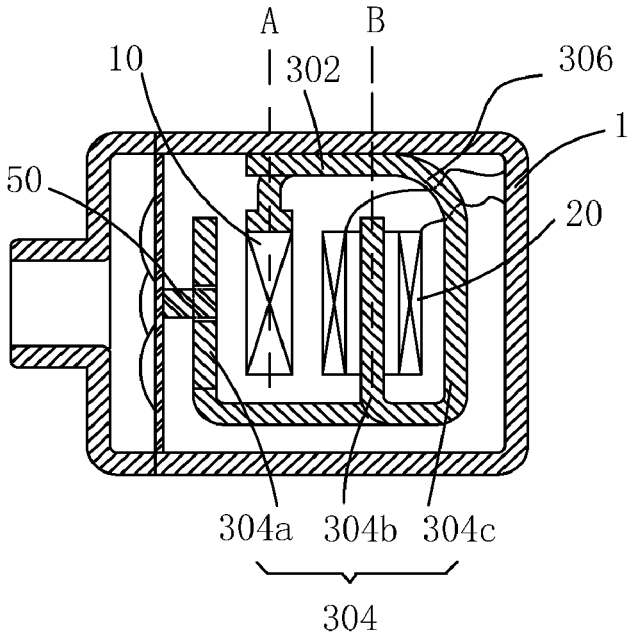
FIG. 5 illustrates a cross-section view of an earpiece according to another exemplary embodiment of the present invention.

FIG. 5 illustrates another exemplary embodiment of the present invention. In this embodiment, the magnet 10 is the fixed element and the coil 20 is the moving element. The extending portion 304 has a similar shape as shown in FIG. 4. The arm 304*a* functions in the same way as earlier described. However, the arm 304*b* serves as the coil pole and is surrounded at least partially by the coil 20. The arm 304*c* is connected to the stationary portion 302 to form the arc 306. When current passes through the coil 20, the net magnetic force causes the coil 20 to move in a direction perpendicular to the axes A and B, thereby causing the arm 304*a* to move or vibrate, about the arc 306.

Figure 6:
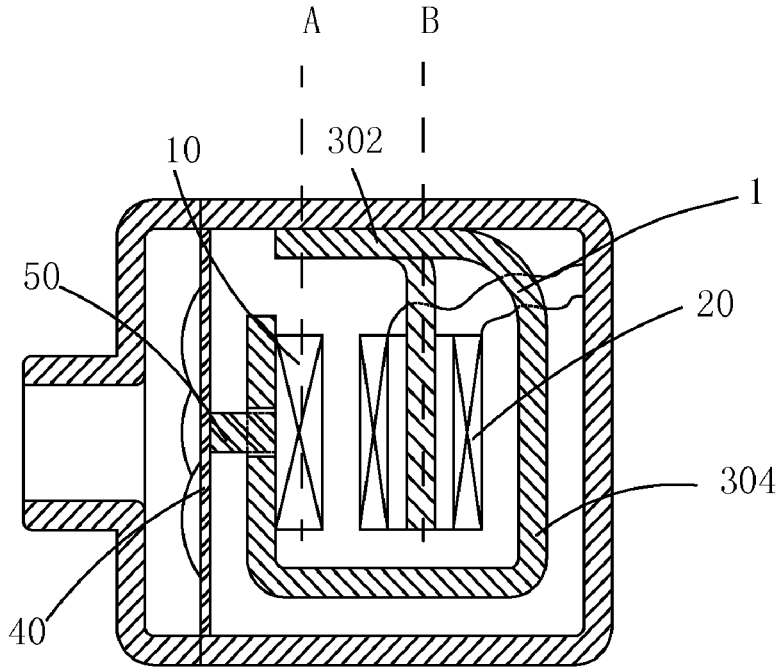
FIG. 6 illustrates a cross-section view of an earpiece according to another exemplary embodiment of the present invention.

Referring to FIG. 6, the coil 20 is the fixed element connected to the frame 1 via the stationary portion 302. The magnet 10 is the moving element. The extending portion 304 forms approximately a "U" shape. The magnet 10 may be placed on either side of the U shape portion of the extending portion 304. In this embodiment, the magnet 10 is placed to the side of the U shape closer to the connecting rod 50. When current passes through the coil 20, magnetic fields generated by the magnet 10 and the coil 20 have two parallel axes A and B. The net magnetic force moves the magnet 10 in a direction perpendicular to the axes A and B, thereby creating vibration. The extending portion 304 then carries the vibration to the diaphragm 40 via the connecting rod 50.

Figure 7:
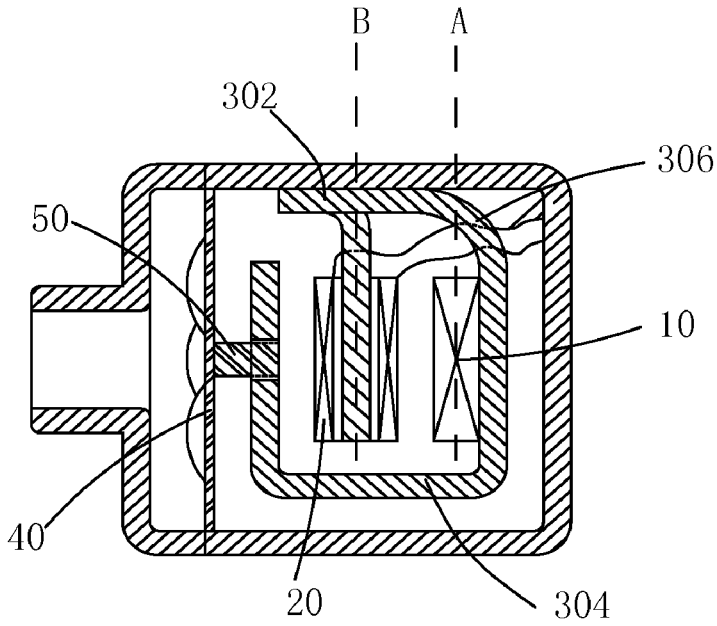
FIG. 7 illustrates a cross-section view of an earpiece according to another exemplary embodiment of the present invention.

With reference to FIG. 7, similar to the structure illustrated in FIG. 6, the coil 20 is the fixed element. The magnet 10 is the moving element. The shape of the extending portion 302 is similar to that of FIG. 6. In this embodiment, the magnet 10 is placed on a different side of the U shape. When the net magnetic force is applied to the magnet 10, it makes the extending portion 304 vibrate about the arc 306 and causes the diaphragm 40 to move via the connecting rod 50.

It will be appreciated by those skilled in the art that changes could be made to the examples described above without departing from the broad inventive concept. It is understood, therefore, that this invention is not limited to the particular examples disclosed, but it is intended to cover modifications within the spirit and scope of the present invention as defined by the appended claims.

What is claimed is:

1. An earpiece for communications, comprising:

a frame;

a vibration system disposed in the frame, the vibration system including a vibrating armature, a diaphragm and a connecting rod, wherein the vibrating armature comprises a stationary portion and an extending portion, the stationary portion being connected to the frame, one end of the extending portion being connected to the stationary portion to form an arc portion and the other end of the extending portion being capable of moving about the arc portion; and a magnetic field system disposed in the frame, the magnetic field system including a magnet to generate a first magnetic field on a first axis and a coil to generate a second magnetic field on a second axis, one of the magnet and the coil being connected to the frame, the first and the second magnetic fields producing a net magnetic force to cause the vibration system to move, wherein the first axis is parallel to the second axis, wherein one of the coil and the magnet is connected to the frame through the stationary portion, the other one of the coil and the magnet is connected to the extending portion.

2. The earpiece of claim 1, wherein the magnet and the coil are disposed in series with the diaphragm.

3. The earpiece of claim 1, wherein the extending portion includes a plurality of arms, a first of the plurality of arms serving as a coil pole, the coil pole being at least partially surrounded by the coil.

4. The earpiece according to claim 3, wherein a second arm of the plurality of arms is connected to the stationary portion to form the arc portion and a third arm of the plurality of arms is connected to the connecting rod.

5. The earpiece of claim 3, wherein the extending portion is substantially a "U" shape.

6. The earpiece of claim 3, wherein the magnet is connected to the extending portion and the coil is connected to the frame via the stationary portion.

7. The earpiece according to claim 3, wherein the coil is connected to the extending portion and the coil is connected to the frame via the stationary portion.

8. An earpiece for mobile communications, comprising:

a frame;

a vibration system including a vibrating armature, a diaphragm and a connecting rod, the vibrating armature having a stationary portion and an extending portion, the stationary portion being connected to the frame, one end of the extending portion being connected to the stationary portion to form an arc portion and the other end of the extending portion being capable of movement; and a magnetic field system including a magnet to generate a first magnetic field on a first axis and a coil to generate a second magnetic field on a second axis, one of the magnet and the coil is connected to the frame through the stationary portion, the first and the second magnetic fields producing a net magnetic force to cause the extending portion to vibrate, the extending portion transmitting vibration to the diaphragm through the connecting rod, wherein the first axis is parallel to the second axis, wherein the other one of the coil and the magnet is connected to the extending portion.

9. The earpiece of claim 8, wherein the net magnetic force is perpendicular to the first axis.

10. The earpiece of claim 8, wherein the extending portion includes a plurality of arms, a first arm of the plurality of arms serving as a coil pole, the coil pole being at least partially surrounded by the coil.

11. The earpiece according to claim 10, wherein a second arm of the plurality of arms is connected to the stationary portion to form the arc portion.

12. The earpiece according to claim 11, wherein a third arm of the plurality of arms is connected to the connecting rod.

13. The earpiece according to claim 11, wherein the coil is connected to the frame through the stationary portion.

14. An earpiece for mobile communications, the earpiece comprising:

a frame;

a vibration system, the vibration system including a vibrating armature, wherein the vibrating armature comprises a stationary portion and an extending portion, the stationary portion being connected to the frame, one end of the extending portion being connected to the stationary portion to form an arc portion and the other end of the extending portion being capable of moving about the arc portion; and a magnetic field system including a magnet to generate a first magnetic field on a first axis and a coil to generate a second magnetic field on a second axis, the first and the second magnetic fields sharing a same space within the frame, and causing the vibration system to move, wherein the magnet and the coil are disposed in series relative to a direction of the movement of the vibration system, wherein one of the coil and the magnet is connected to the frame through the stationary portion, the other one of the coil and the magnet is connected to the extending portion.

15. The earpiece of claim 14, wherein the first and the second magnetic fields produce a net magnetic force, the net magnetic force being perpendicular to the first axis.

16. The earpiece of claim 14, wherein the extending portion includes a plurality of arms, a first arm of the plurality of arms serving as a coil pole, the coil pole being at least partially surrounded by the coil, a second arm of the plurality of arms being connected to the stationary portion to form the arc portion, and a third arm of the plurality of arms being connected to the connecting rod.

17. The earpiece according to claim 16, wherein the coil is connected to the frame through the stationary portion.

* * * * *